United States Patent [19]

Wald et al.

[11] Patent Number: 4,892,777

[45] Date of Patent: Jan. 9, 1990

[54] FINE-GRAINED COATED LAMINATE IN CONTINUOUS WEB FORM

[75] Inventors: Hanns J. Wald, Waldmichelbach; Wilfried Getrost, Mölenbach; Sigrid Lang, Birkenau, all of Fed. Rep. of Germany

[73] Assignee: Firma Carl Freudenberg, Weinheim/Bergstr, Fed. Rep. of Germany

[21] Appl. No.: 334,602

[22] Filed: Apr. 6, 1989

[30] Foreign Application Priority Data

Apr. 19, 1988 [DE] Fed. Rep. of Germany ..... 3812948

[51] Int. Cl.[4] ..... B32B 7/00

[52] U.S. Cl. ..... 428/212; 156/247; 156/314; 156/315; 428/151; 428/215; 428/219; 428/252; 428/253; 428/286; 428/904

[58] Field of Search ..... 428/151, 212, 215, 219, 428/252, 253, 286, 521, 904; 156/247, 314, 315

[56] References Cited

U.S. PATENT DOCUMENTS

| | | | |
|---|---|---|---|
| 4,764,412 | 8/1988 | Burns et al. | 428/904 |
| 4,835,063 | 5/1989 | Jadamus et al. | 428/521 |

*Primary Examiner*—Marion C. McCamish
*Attorney, Agent, or Firm*—Felfe & Lynch

[57] ABSTRACT

A coated laminate in web form, having a fine-grained surface, consists of a nonwoven fabric with a coating, with a plain knit or woven fabric situated between the coating and the nonwoven fabric. Its production is performed by a reverse procedure on a release paper.

8 Claims, No Drawings

FINE-GRAINED COATED LAMINATE IN CONTINUOUS WEB FORM

FIELD OF THE INVENTION

This invention relates to a coated laminate in continuous web form, which has a fine-grained surface and consists of a nonwoven fabric with a coating and a smooth knitted or woven fabric between the coating and the nonwoven fabric, as well as to a method for its manufacture by a reversal process on a release paper.

Such laminates are useful as synthetic leathers for the manufacture of shoes with a fine-grained surface finish and unfinished edges.

BACKGROUND OF THE INVENTION

It is known to process fine-grained synthetic leather made of polyurethane or PVC-coated fabric into shoe upper material. Open-edge processing, however, is impossible due to the danger of fraying at cut edges and because the punching of perforations is not clean.

In the case of synthetic leathers made from impregnated, coated nonwovens the production of fine-grained surfaces is virtually impossible, because in high-stretch areas, especially at the toe cap when it is drawn down in shoemaking, the fine graining is destroyed because the nonwoven texture shows through. The ultra-fine nonwoven fiber materials often used for that reason involve very high production costs.

West German Gebrauchsmuster (DE-GM) No. 87 02 810 describes a piece of artificial leather in which the showing through of the nonwoven fabric is said to be eliminated by needling a knitted or woven fabric into the nonwoven fabric. A disadvantage of this arrangement is that the woven or knitted fabric is damaged by the needling and has to be covered on at least one side with a thin nonwoven fabric layer for the purpose of securely anchoring it.

Even this minimal nonwoven fabric layer again causes the texture of the nonwoven fabric to show through on fine-grained surfaces, especially when the material is shaped.

OBJECTS OF THE INVENTION

It is an object of the present invention to provide a laminate of the type referred to above which has a fine-grained surface, but in which the underlying texture will not penetrate through to the covering layer, and the strength and appearance of the cut edges of which are equal to those of natural leather.

DESCRIPTION OF THE INVENTION

We have discovered that the above objects are achieved by a coated laminate material in web form having a leather-like appearance and fine-grained surface and a thickness of 0.7 to 5.0 mm, consisting of an 0.03 to 0.4 mm thick, soft PVC, polyurethane, NBR, SBR or acrylate coating, an adhesive coating, and an 0.2 to 3.5 mm thick supporting layer having a specific weight of 30 to 500 g/m$^2$ of nonwoven fabric, or of a woven fabric impregnated with acrylate dispersion, wherein, between the supporting layer and the coating, a smooth-textured knitted fabric having a specific weight of 30 to 200 gm/m$^2$ or a smooth-textured woven fabric having a specific weight of 100 to 500 gm/m$^2$ is placed, consisting of polyester, polyamide, or cotton fibers or mixtures thereof, this intermediate layer being surrounded on both sides by a soft polymer layer joining the supporting layer to this intermediate layer, and the laminate material in the embedded state having an elongation at rupture of at least 8% and, even after shaping, has a surface free of nonwoven textures.

By embedding the woven or knit material into the two adhesive polymer layers, fraying is prevented in open-edge fabrication.

The woven or knit interlayer is to have a very smooth surface on both sides so that, on the one hand, no texture will show through on the surface in shoe manufacture and, on the other hand, so that not too much adhesive will be necessary in the fabricating process when it is bonded to the supporting layer, whereby the end product will remain flexible, soft and round. In the interest of workability, the knit or woven intermediate layer must have an elongation at rupture of at least 8% after it is embedded in the two adhesive coats.

To achieve the required cut edge strength, the supporting layer is preferably an impregnated needled nonwoven. The desired end strength of the laminate can be established by supporting layer thicknesses between 0.2 to 3.5 mm. If the supporting material is a weave, the cut-edge strength must be assured by impregnation.

In one preferred embodiment, the face of the laminate consists of a PVC, polyurethane or acrylate varnish with a specific weight of 1 to 2 g/m$^2$. These include a soft PVC layer containing 45 to 65 percent by weight of plasticizer, or a polyurethane layer.

A soft PVC with a plasticizer content of 45 to 65 percent by weight has been found to be especially suitable.

On account of its smooth surface texture, a polyester fabric jersey having a specific weight of 100 g/m$^2$ was found to be especially suitable as the intermediate layer.

We have also found that an impregnated needled nonwoven polyester as the supporting layer for a laminate constructed in accordance with the invention imparted the product with an especially significant leather likeness and an advantageous "round break."

With regard to the method of manufacturing the laminate material, it is important in the context of the invention that first the intermediate layer be applied to the face layer and then the supporting layer be applied to the intermediate layer. The cementing must be performed with adhesive coatings, hot-melt adhesives or adhesive films of very soft consistency.

In a preferred process variant, a solvent-containing cover varnish, made of PVC for example, is first applied to a release paper provided with a fine texture, and the solvent is removed in a circulating air oven. This varnish is coated with a soft covering paste, and the latter is dried in the circulating air oven.

The application of the intermediate layer and supporting layer is performed successively, each by means of a soft adhesive paste, hot-melt adhesive or adhesive film, which is dried, if necessary, in a circulating air oven after each application. Only then, after cooling the entire laminate, is the release paper removed. By this procedure the fine-grained surface is protected during the adhesion process.

In a second process variant, plain release paper is used. The fine-grained surface is produced by means of a graining calander with a fine-grained roller surface. The lamination of the supporting layer can also be performed in a separate step, but before the calandering. After texturing, the goods can be imprinted and varnished, if desired.

The following examples illustrate the present invention and will enable others skilled in the art to understand it more completely. It should be understood, however, that the invention is not limited solely to the particular examples given below.

EXAMPLE 1

A solvent-containing PVC varnish was applied at the rate of 2 gm/m$^2$ (solid) to a fine-grained release paper, and the varnish was dried in a first circulating air oven at 160° C.

300 g/m$^2$ of a soft PVC paste containing 50 percent by weight of plasticizer was applied to the dried varnish and gelled in a second circulating air over at 190° C. Then, with the aid of 100 g/m$^2$ of a soft PVC adhesive coating having a plasticizer content of 55 percent by weight, a polyester jersey fabric having a specific weight of 100 g/m$^2$ was laminated onto the gelled PVC coating, and the adhesive coating was gelled in a third circulating air oven at 190° C. The supporting layer, a polyester needled nonwoven 0.8 mm thick and having a specific weight of 200 g/m$^2$ was then laminated onto the jersey with 300 g/m$^2$ of the same adhesive coating as above. To gel the second adhesive coat, the entire laminate with the release paper was heated in a fourth circulating air oven at 190° C. After cooling, the entire laminate, a fine-grained sport shoe upper material of good cut-edge strength, was separated from the release paper.

EXAMPLE 2

The procedure was the same as in Example 1, but an impregnated needled nonwoven material 1.1 mm thick and having a specific weight of 300 g/m$^2$ was used as the supporting material. The end product, useful as a shoe upper material, had a thickness of 1.8 mm.

The advantages of the present invention thus lie in the possibility of producing fine-grained shoe upper materials which can also be fashioned with unfinished edges. In comparison with genuine leather and with fine-grained qualities made with ultra-fine fibers, the product in accordance with the present invention and its manufacturing process are distinguished by manufacturing costs that are as much as 50% lower.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. A coated laminate material in web form, with leather-like appearance and fine-grained surface and a thickness of 0.7 to 5.0 mm, consisting of an 0.03 to 0.4 mm thick, soft PVC, polyurethane, NBR, SBR or acrylate coating, an adhesive coating, and an 0.2 to 3.5 mm thick supporting layer having a specific weight of 30 to 500 g/m$^2$ of nonwoven fabric, or of a woven fabric impregnated with acrylate dispersion, wherein, between the supporting layer and the coating, a smooth-textured knitted fabric having a specific weight of 30 to 200 gm/m$^2$ or a smooth-textured woven fabric having a specific weight of 100 to 500 gm/m$^2$ is placed, consisting of polyester, polyamide, or cotton fibers or mixtures thereof, this intermediate layer being surrounded on both sides by a soft polymer layer joining the supporting layer to this intermediate layer, and the laminate material in the embedded state having an elongation at rupture of at least 8%.

2. A laminate of claim 1, wherein the coating is a varnish layer of a PVC, PUR or acrylate varnish which is situated on a soft PVC layer with a plasticizer content of 45 to 65 percent by weight or on a polyurethane layer.

3. A laminate of claim 2, where the intermediate layer of woven or knit material is coated on both sides with a soft PVC adhesive coat having a plasticizer content of 45 to 65 percent by weight.

4. A laminate of claim 1, where the intermediate layer is a polyester jersey fabric having a specific weight of 100 g/m$^2$.

5. A laminate of claim 1, where the supporting layer is an impregnated polyester needled nonwoven.

6. The method of making a coated laminate material in web form of claim 1, which comprises the following sequence of steps:

(a) Application of the top coat to release paper, followed by drying in a circulating air oven;

(b) Lamination of the knit or woven intermediate layer onto the cover layer by means of a soft, adhesive polymer layer, followed by drying in a circulating air oven;

(c) Lamination of the supporting layer onto the intermediate layer by means of an adhesive polymer layer and then, if desired, drying of the laminate in a circulating air oven, and (d) Cooling of the laminate followed by removal of the release paper.

7. The method of claim 6, wherein before the application of the soft cover paste, a solvent-containing cover varnish is applied to release paper having a fine texturing, and then the solvent is removed in a circulating air oven.

8. The method of claim 6, wherein a plain release paper is used and then, following the production of the laminate, the texture is produced on the cover layer by rolling it with a texturing calander, then the cover layer is imprinted, if desired, and varnished.

* * * * *